US011002296B2

(12) United States Patent
Katanjian

(10) Patent No.: US 11,002,296 B2
(45) **Date of Patent: *May 11, 2021**

(54) PRESSURE CONTROLLED HYDRAULIC ENGINE

(71) Applicant: Koko Krikor Katanjian, Farmers Branch, TX (US)

(72) Inventor: Koko Krikor Katanjian, Farmers Branch, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/836,604

(22) Filed: Mar. 31, 2020

(65) Prior Publication Data

US 2020/0224535 A1 Jul. 16, 2020

Related U.S. Application Data

(63) Continuation of application No. 15/572,621, filed as application No. PCT/US2016/036412 on Jun. 8, 2016, now Pat. No. 10,605,082.

(60) Provisional application No. 62/172,526, filed on Jun. 8, 2015.

(51) Int. Cl.

| | |
|---|---|
| ***F15B 11/072*** | (2006.01) |
| ***F01B 29/12*** | (2006.01) |
| ***F01B 1/04*** | (2006.01) |
| ***F15B 11/064*** | (2006.01) |
| ***F01B 17/04*** | (2006.01) |
| ***F01B 17/02*** | (2006.01) |
| *F01B 23/00* | (2006.01) |

(52) U.S. Cl.

CPC ..... *F15B 11/0725* (2013.01); *F01B 1/04* (2013.01); *F01B 17/025* (2013.01); *F01B 17/04* (2013.01); *F01B 29/12* (2013.01); *F15B 11/064* (2013.01); *F01B 23/00* (2013.01)

(58) Field of Classification Search

CPC ..... F15B 11/064; F15B 11/0725; F01B 1/04; F01B 17/04; F01B 29/12

USPC ..... 60/370, 371, 412, 413, 416

See application file for complete search history.

(56) References Cited

U.S. PATENT DOCUMENTS

| | | | | |
|---|---|---|---|---|
| 4,052,850 | A | 10/1977 | Mohaupt | |
| 4,769,988 | A | 9/1988 | Clark, Jr. | |
| 4,896,505 | A | 1/1990 | Holleyman | |
| 5,515,675 | A | 5/1996 | Bindschatel | |
| 5,616,005 | A | 4/1997 | Whitehead | |
| 6,065,945 | A | 5/2000 | Zamzow | |
| 6,629,573 | B1 | 10/2003 | Perry | |
| 8,360,743 | B2 | 1/2013 | Walters | |
| 9,470,110 | B2 | 10/2016 | Stroganov et al. | |
| 10,605,082 | B2 * | 3/2020 | Katanjian | F01B 1/04 |
| 2010/0296949 | A1 | 11/2010 | Corley | |
| 2013/0047595 | A1 | 2/2013 | Khajepour | |

* cited by examiner

*Primary Examiner* — Michael Leslie

(57) ABSTRACT

An engine and corresponding driving propulsion system may provide continuous force necessary to keep the engine operating. Utilizing two pressurized tanks with high and low pressures may provide a continuous flow of pressure to the engine necessary for it to operate.

20 Claims, 16 Drawing Sheets

700

PRESSURE CONTROLLED HYDRAULIC ENGINE

TECHNICAL FIELD OF THE APPLICATION

This application relates to a gas controlled engine and more particularly to a closed loop air pressure regulated force generating system that uses air to generate engine propulsion.

BACKGROUND OF THE APPLICATION

Conventionally, engines, or simply just motors, are controlled by gas combustion. Also, presently there are many electric motors in existence as well especially with the advent of electric cars which continue to grow in popularity. However, there remains many other uses for engines other than motor vehicles, such as power generators, small engine devices, factory machinery, household and yard devices, etc., which could afford to have less torque and power and could be run efficiently without high power combustion engines.

SUMMARY OF THE APPLICATION

One embodiment of the present application may include an apparatus that has a plurality of pressurized air tanks controlled by a compressor. Also, an engine is coupled to the tanks via air piping which permits the changes in pressure to cause the air to operate the pistons and create movement within the engine in a continuous state of operation.

DETAILED DESCRIPTION OF THE APPLICATION

It will be readily understood that the components of the present application, as generally described and illustrated in the figures herein, may be arranged and designed in a wide variety of different configurations. Thus, the following detailed description of the embodiments of an apparatus, and system configuration, as represented in the attached figures, is not intended to limit the scope of the application as claimed, but is merely representative of selected embodiments of the application.

The features, structures, or characteristics of the application described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment of the present application. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

Figure 1A:
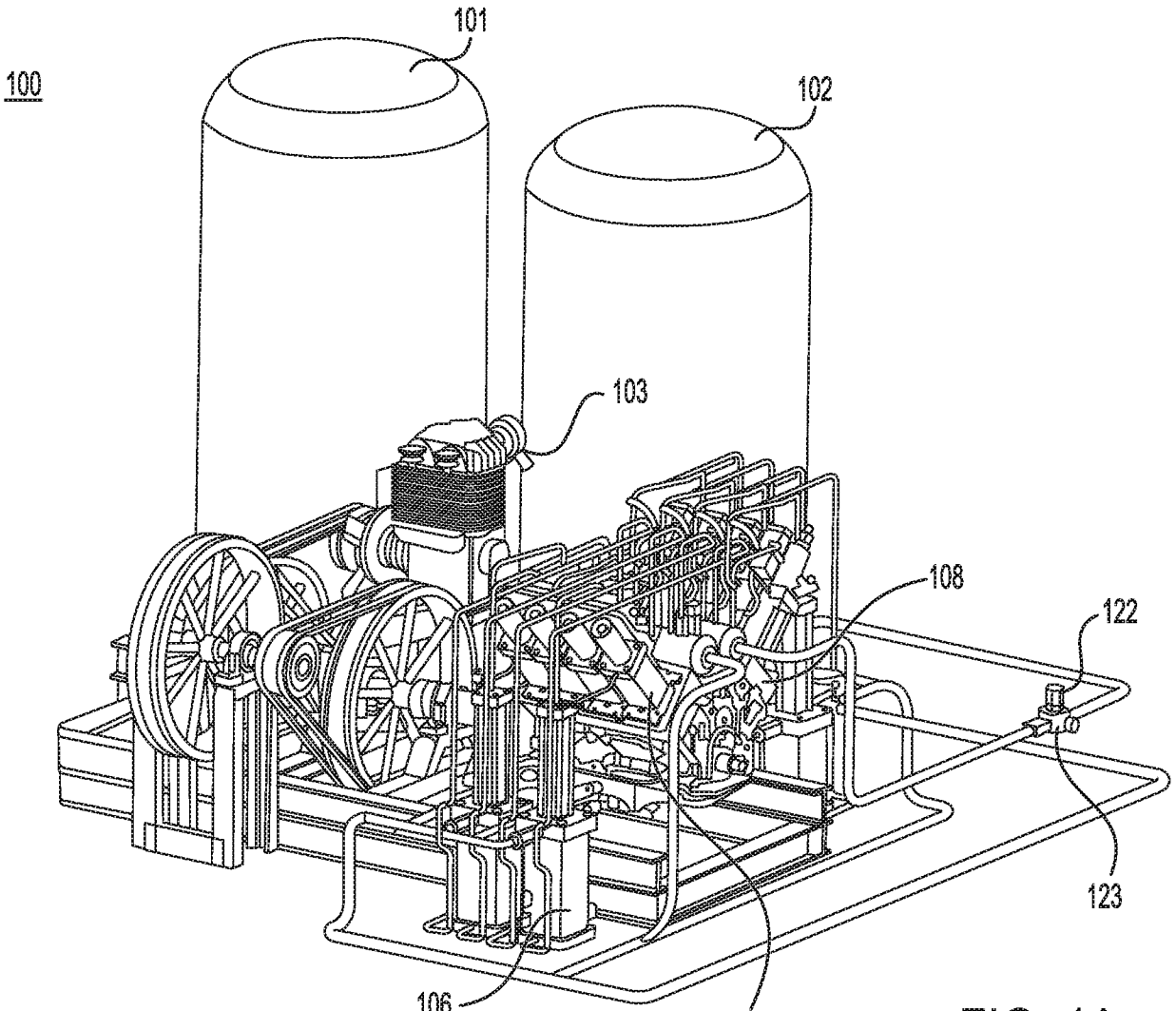
FIG. 1A illustrates an example angled view of the engine system according to example embodiments.

FIG. 1A illustrates an example angled view of the engine system according to example embodiments. Referring to FIG. 1A, the overall propulsion components and engine operating features are illustrated together in an integrated hydraulic ram propulsion and engine operation model 100. The air tank 101 includes a low pressure or pound per square inch (PSI) tank which holds low pressure air in the tank with respect to the air pressure in the second tank 102. The high PSI tank 102 holds high pressure air with respect to the low pressure tank 101. The air compressor 103 is connected to both tanks via air passage channels or pipes and transfers the low pressure air from low pressure tank 101 to high pressure tank 102. For purpose of this disclosure, like numerals and reference indicators in the drawings refer to like components throughout the disclosure. Also, the term "air" refers to a simple gas used throughout the system 100 and may be modified to include an air mix, helium, hydrogen, nitrogen, oxygen or a mix of different gases.

Figure 1B:
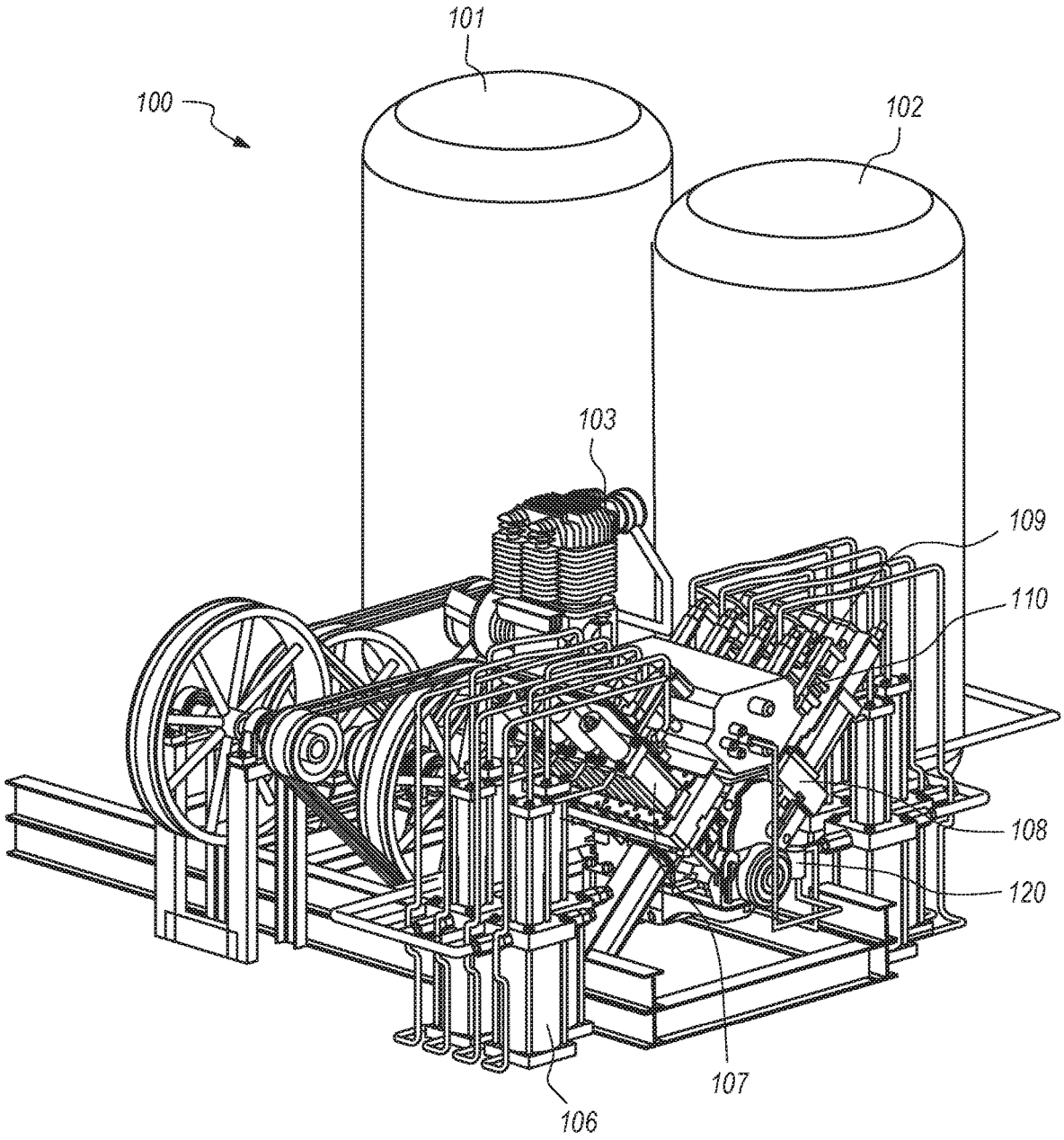
FIG. 1B illustrates another example angled view of the engine system according to example embodiments.

FIG. 1B illustrates another example angled view of the engine system according to example embodiments. Referring to FIG. 1B, this angle provides a view of a hydraulic ram cylinder 107 which has two chambers including an oil chamber and an air chamber. The hydraulic ram cylinder head adapter 108 is an adapter that receives the ram cylinder 107. An air cylinder control valve 109 controls pressurizing the air cylinder 106 and depressurizing air cylinder 106 and ram cylinder 107. The hydraulic control valve 110 permits the oil to return to a starting position freely. An air check valve 111 permits the air to travel in one direction. The throttle valve regulates the amount of air pressure that can be used. The oil pump 120 includes an engine oil pan where the oil is pumped back into the engine for lubrication.

Figure 2A:
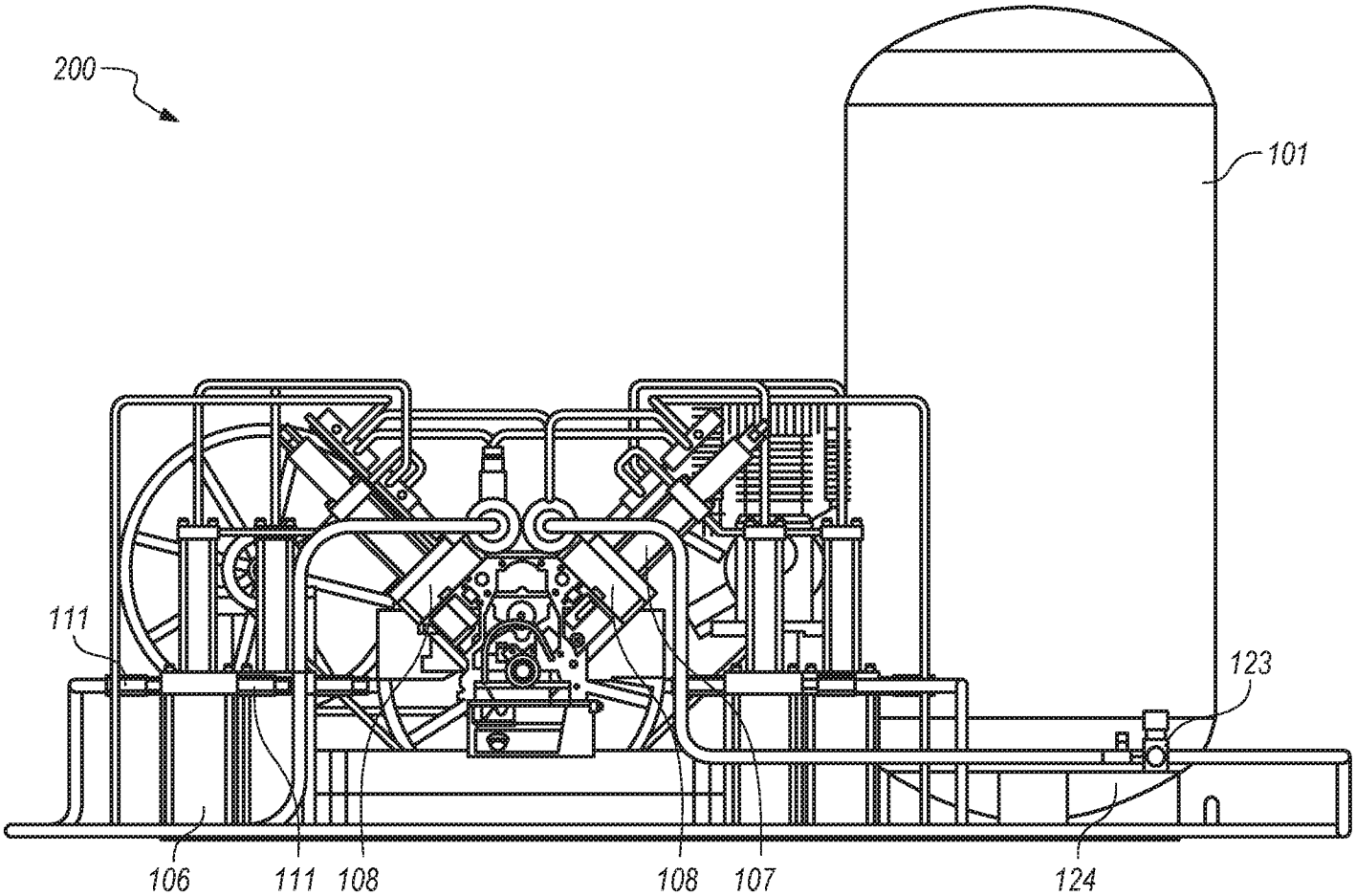
FIG. 2A illustrates an example side view of the engine system according to example embodiments.

FIG. 2A illustrates an example side view of the engine system according to example embodiments. Referring to FIG. 2A, the system 200 includes a view of the low pressure tank 101. A hydraulic piston over the air cylinder 106 is an air cylinder component. A hydraulic ram cylinder 107 has two chambers including an oil chamber and an air chamber. The hydraulic ram cylinder head adapter 108 is an adapter that receives the ram cylinder 107. An air cylinder control valve 109 (see FIG. 2B) controls pressurizing the air cylinder 106 and depressurizing air cylinder 106 and ram cylinder 107. The hydraulic control valve 110 (see FIG. 2B) permits the oil to return to a starting position freely. An air check valve 111 permits the air to travel in one direction. The throttle valve regulates the amount of air pressure that can be used.

Figure 2B:
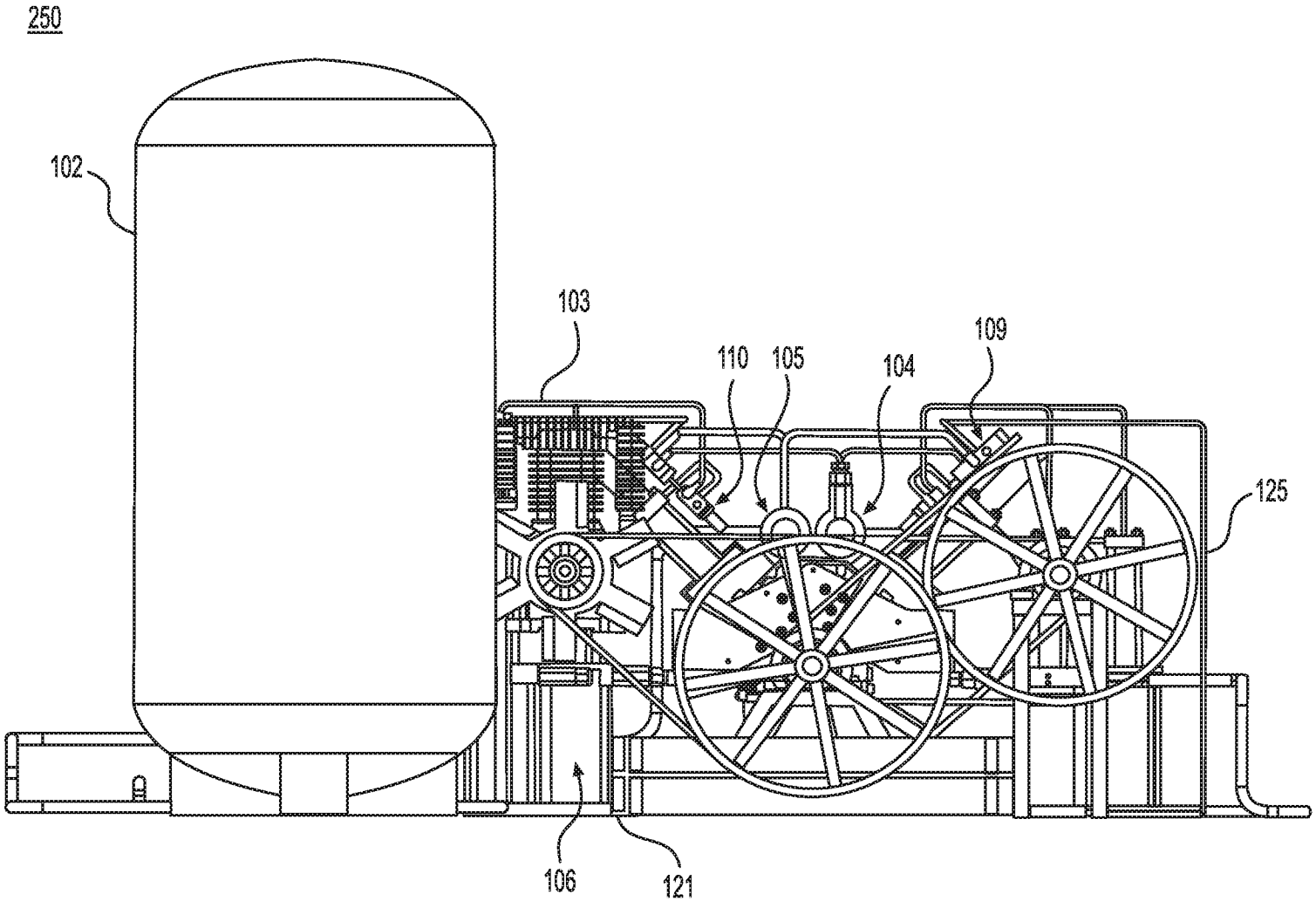
FIG. 2B illustrates an example opposite side view of the engine system according to example embodiments.

FIG. 2B illustrates an example opposite side view of the engine system according to example embodiments. Referring to FIG. 2B, the system 250 includes a view of the high pressure tank 102 and various other components. A low PSI manifold 104 holds and distributes air to more than one line. A transmission 125 operates to change the gears. A high PSI manifold 105 holds and distributes air to more than one line. A pressure valve 121 is used to identify the pressure in the system. The hydraulic piston over air cylinder or air cylinder has two chambers including chamber A and chamber B. Over the air cylinder is a mounted booster cylinder, which is filled with oil. As the chamber A is energized with high pressure air, the air enters into the booster ram cylinder. This action transfers the oil into the ram cylinder (which is item #7A) extending the cylinder rod to a down position. Now, to retract the cylinder rod to a home position, this action can be achieved by two ways. One way is mechanically, as ram cylinder rod or hydraulic ram cylinder extends to a down position of 180 degrees on the crank shaft, at that point, the crank continues to rotate around 360 degrees. This permits the rotation, and hydraulic piston over air cylinder "chamber A" exhausts the compressed air, which is captured back to the low pressure tank 101. This is a closed loop configuration where the exhausted pressure is conserved and provided back to the initial compression stage of the system. By exhausting the pressure into chamber A, the hydraulic ram cylinder rod will return to a home position, which is in an up position.

Additionally, to increase torque, each cylinder can be fired singularly or in a double/quadruple capacity depending on the needed torque. During retraction, more air can be generated by using the hydraulic piston over air cylinder 106, chamber B of the cylinder can compress new air into the system. As the exhaust air is captured into the low pressure tank 101, air compressor 103 moves the low pressure air up into the high pressure tank 102. The system repeats the process autonomously without requiring additional energy sources.

Figure 3A:
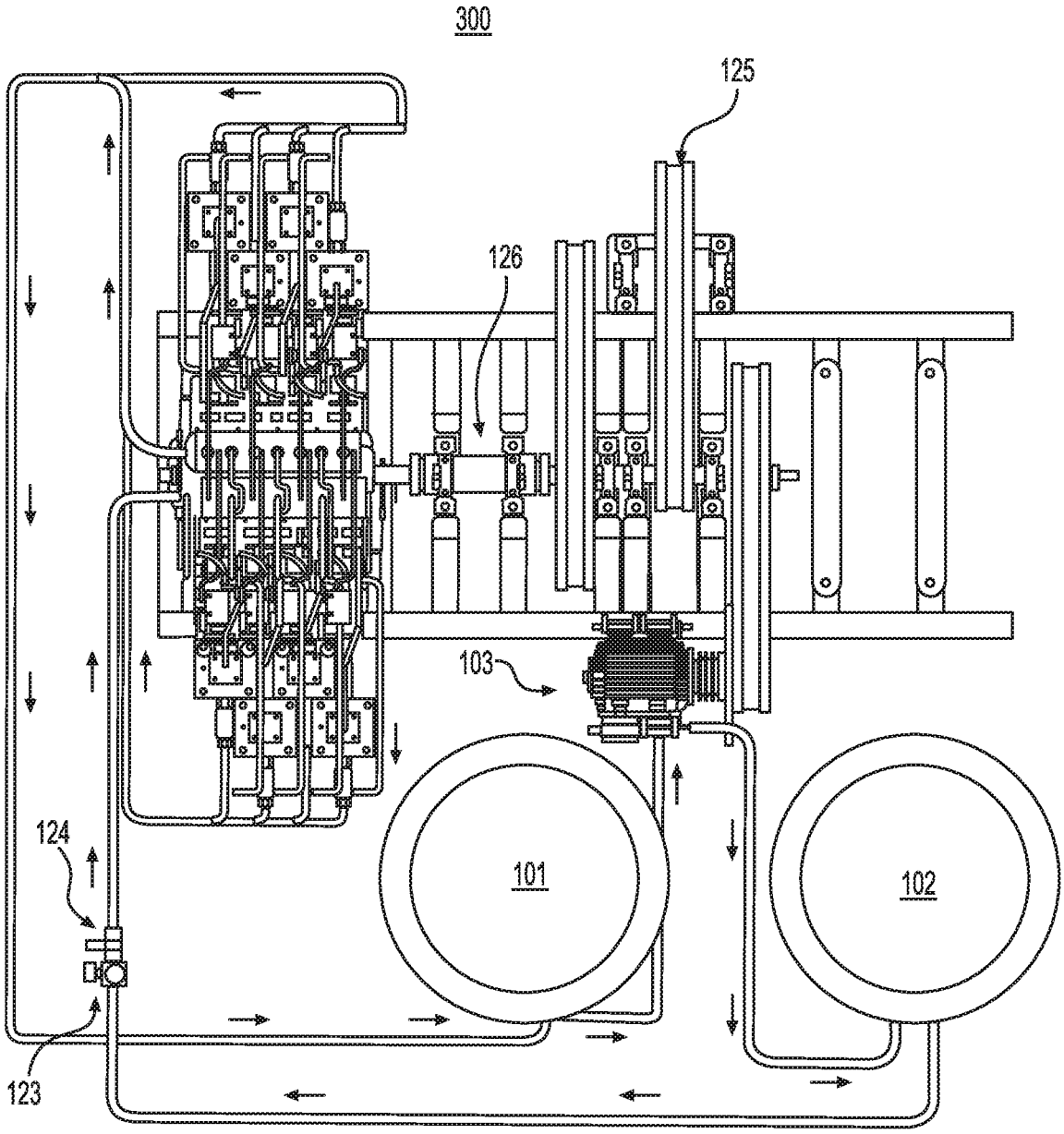
FIG. 3A illustrates an example top view of the engine system according to example embodiments.

FIG. 3A illustrates an example top view of the engine system according to example embodiments. Referring to FIG. 3, the system 300 includes the transmission 125 and a corresponding clutch 126 used to operate the transmission 125. The throttle valve 123 and pressure regulator 122 control the air flow. According to one example embodiment, to start the operation of the system, pressurize air tank 101 is set to 50 psi and air tank 102 is set to 150 psi. Tank 102 is connected to the high PSI manifold 105 by piping. On the pipeline there is an air pressure regulator. The air regulator, regulates the air from 150 psi to 100 psi. At the 100 psi line, there is a throttle valve, which controls the flow of air. As the high psi manifold 105 is pressurized, the air cylinder control valve is pressurized. As the throttle permits the air to reach the air control valve 109 then the hydraulic piston over air cylinder 106 'chamber A' is energized. The air compressor 103 can be operated electrically in a standalone system as well as it can be incorporated within the system. It could run with or without air tanks and only with the compressor. To increase rpm, the transmission is attached to the rear of the engine, or to the front of the engine, or front and rear of the engine simultaneously. In general, there is no need for electricity, however, the system can be operated by air and electrical electronics and magnetic and laser components and even a computer operated module.

Figure 3B:
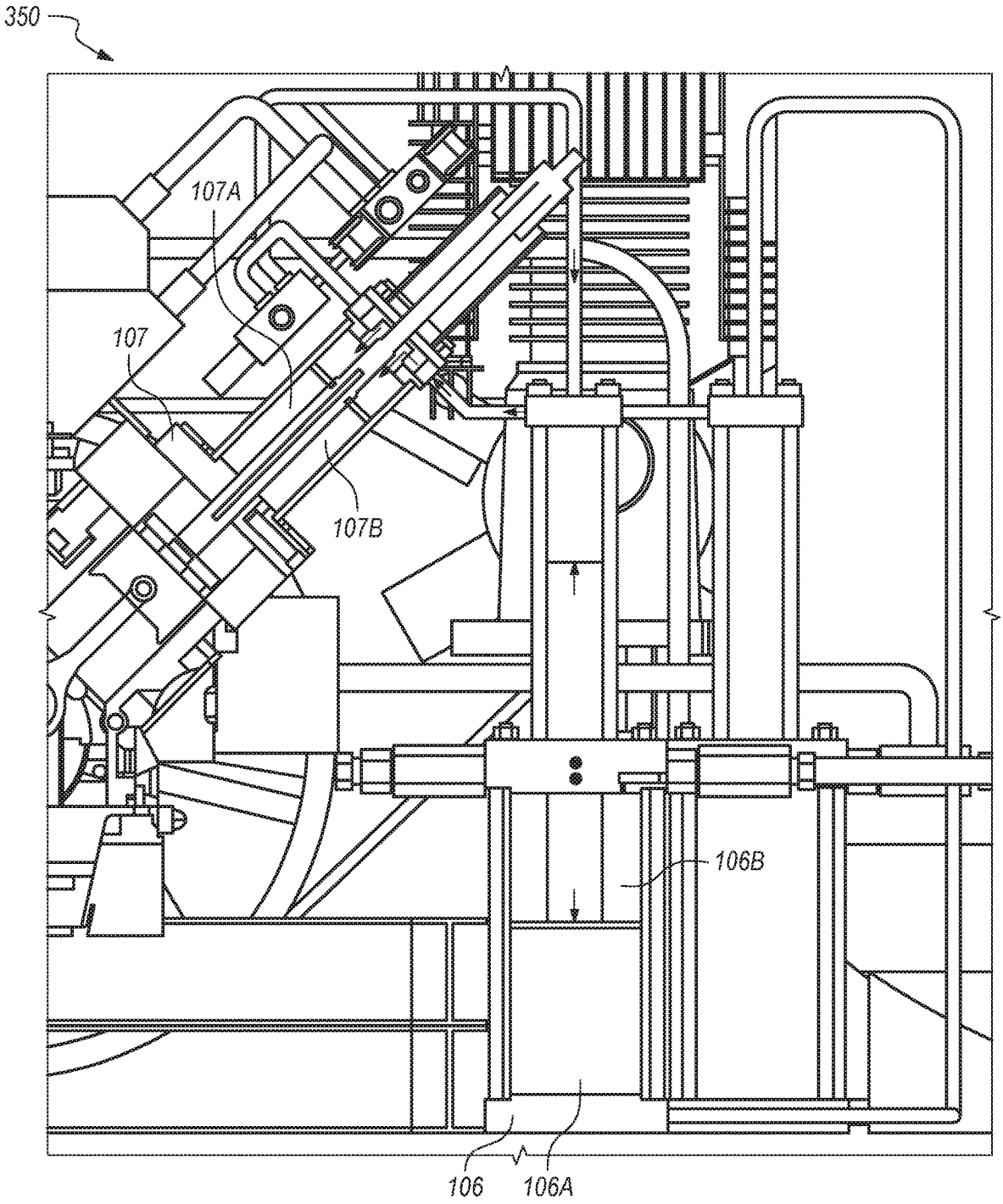
FIG. 3B illustrates a close-up view of the air chamber and ram cylinder according to example embodiments.

FIG. 3B illustrates a close-up view of the air chamber and ram cylinder according to example embodiments. Referring to FIG. 3B, the configuration includes a hydraulic ram cylinder 107 with an air chamber 107B and an oil chamber 107A. Also, an oil chamber and oil cylinder are in contact with a shaft that moves up and down with the movement of the air hydraulic booster 106 which includes the air chamber 106A and the air chamber 106B.

Figure 4:
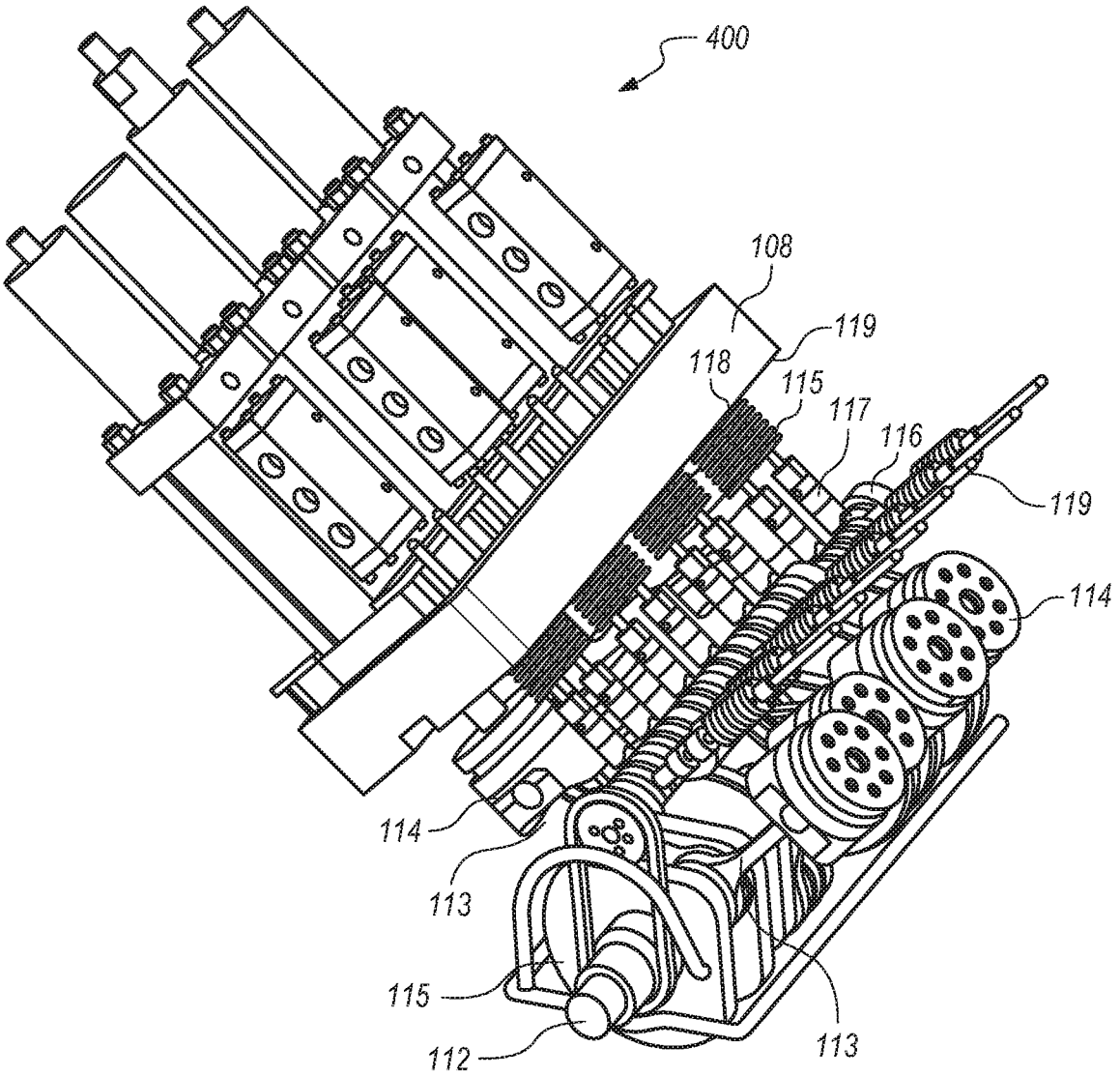
FIG. 4 illustrates an example view of the engine by itself according to example embodiments.

FIG. 4 illustrates an example view of the engine by itself according to example embodiments. Referring to FIG. 4, to de-energize the air cylinder 'chamber B' on the hydraulic piston over air cylinder 106, as energizing and de-energizing item 106, it causes the crank shaft 112 to rotate 360 degrees. Now, this action is repeated by specific firing order as each cylinder follows the firing order. This could be operated from 3 cylinders up to 24 cylinders or more. All control systems can be operated by means of electricity, air, magnetic, electronic and laser control systems.

This engine configuration can be many different designs including a 90 degree 'V' design, an in-line design, a flat engine design, a radial engine design, and a scissoring engine design. The compressor 103 can be operated electrically in a standalone system as well as it can be incorporated within the system. It could run with or without air tanks, only with compressor. The compressor may be a piston type compressor and/or a screw type compressor. To increase rpm, the transmission 125 is attached to the rear of the engine, or to the front of the engine, or front and rear of the engine simultaneously. The transmission will adjust the number of RPMs.

The hydraulic ram cylinder head adapter 108 receives the 107 cylinder. The air cylinder control valve 109 controls pressurizing the hydraulic piston over air cylinder 106 and depressurizing item 106 and 107. The hydraulic control valve 110 permits the oil to return to a home position freely. The air check valve permits the air to travel in one direction. Crank shaft 112 is the main rotating shaft of the engine 400. Connecting rods 113 connect the crank shaft 112 to the ram cylinder rod adapter 114, which connects the ram cylinder 107 to the connecting rods 113.

The timing gear assembly with chain 115 synchronizes the crank shaft 112 to the cam shaft 116, which controls the firing order and the duration of the air and hydraulic valves. Solid lifters 117 roll over the cam to lift the push rods to an up and down type of movement. Push rod and spring assembly 118 connects to the cam shaft. The linear bearing 119 maintains the push rods into position.

Figure 5:
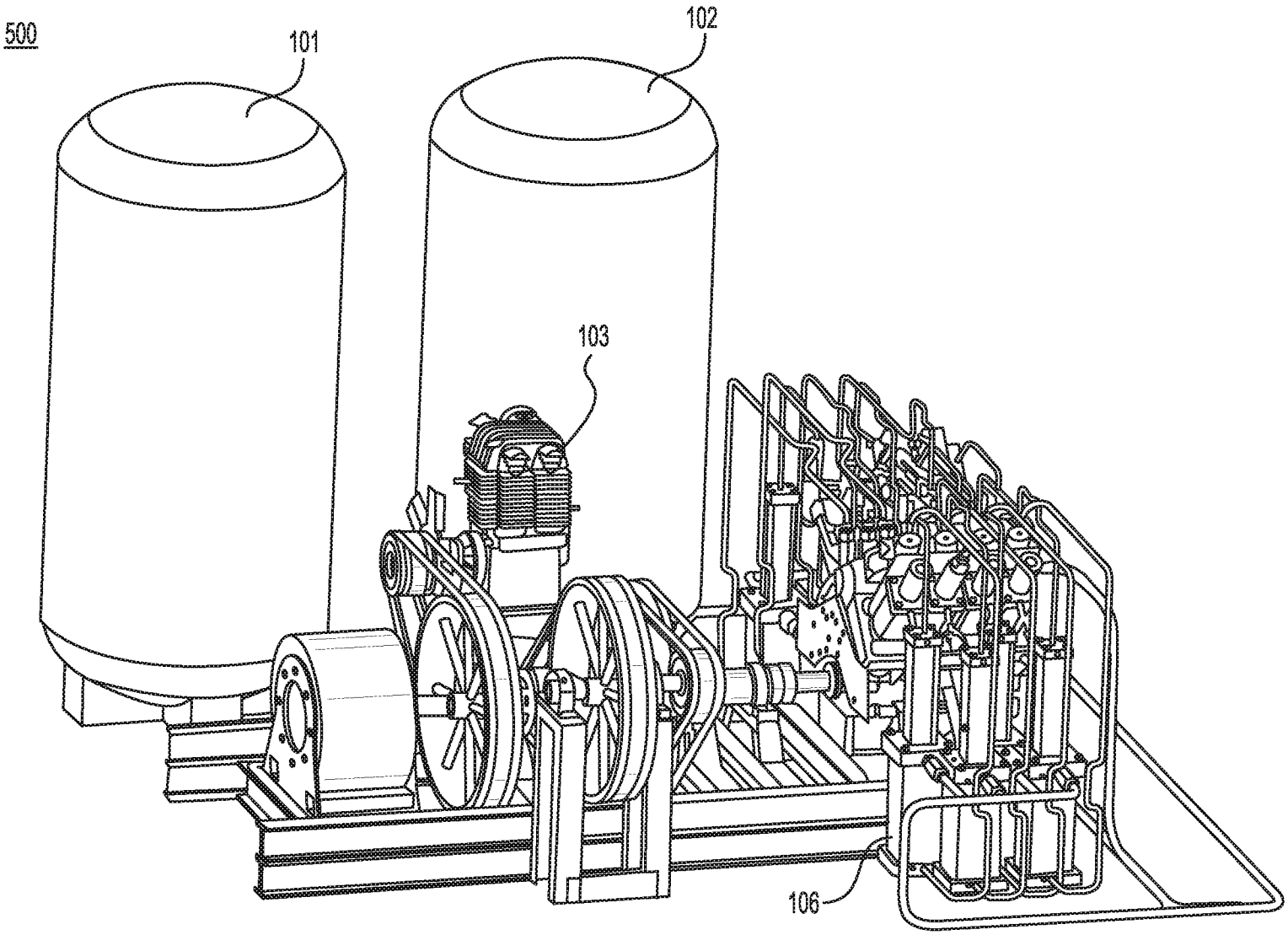
FIG. 5 illustrates another front view perspective according to example embodiments.

FIG. 5 illustrates another front view perspective according to example embodiments. Referring to FIG. 5, the system 500 includes the same reference numerals which refer to like components in other drawings.

Figure 6:
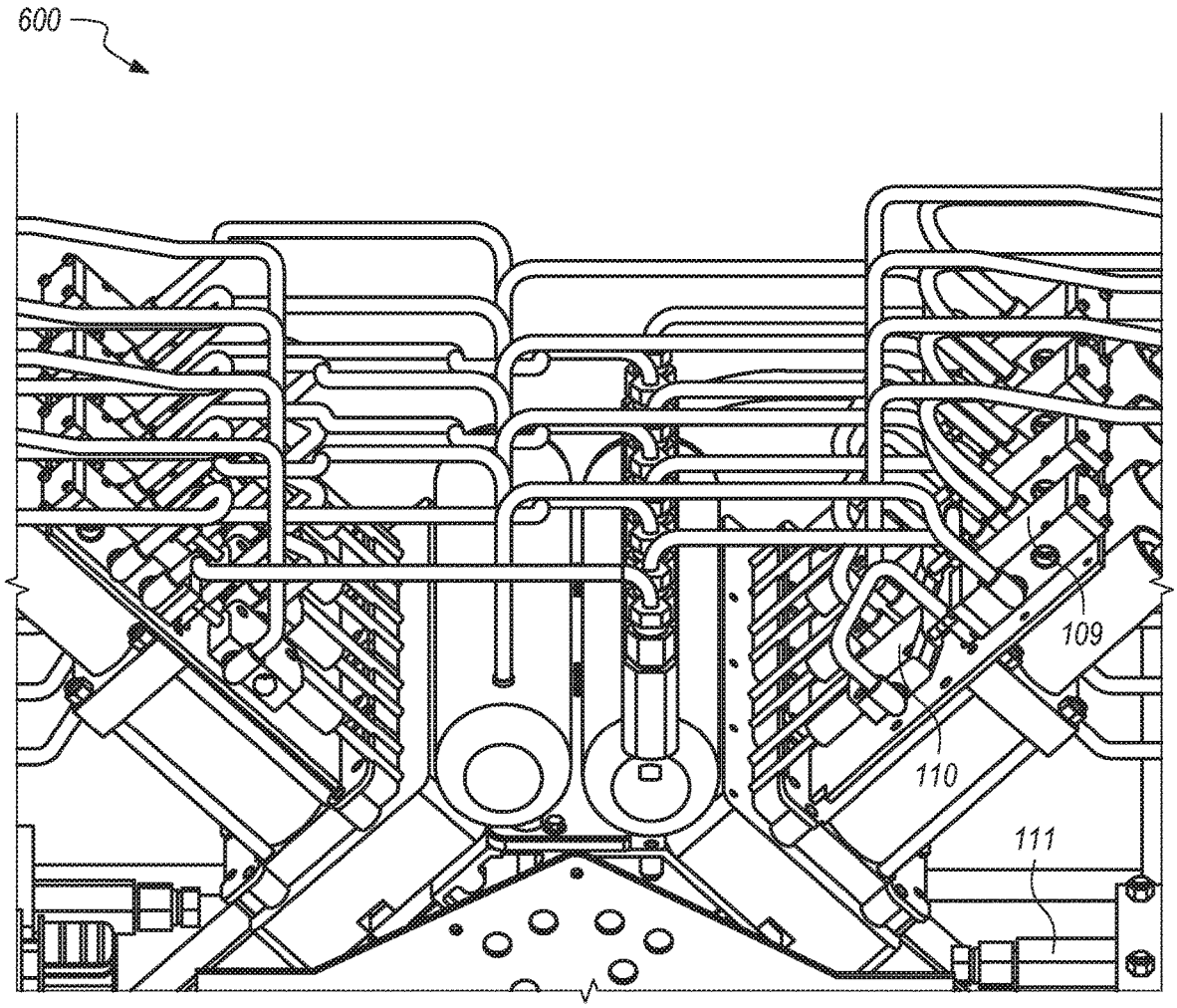
FIG. 6 illustrates an example view of the engine air pipes according to example embodiments.

FIG. 6 illustrates an example view of the air hydraulic booster according to example embodiments. Referring to FIG. 6, the close-up perspective illustrates the air cylinder control valve 109, the hydraulic control valve 110 and the air check valve 111. The air hydraulic booster transfers the air pressure to the hydraulic presser.

Figure 7:
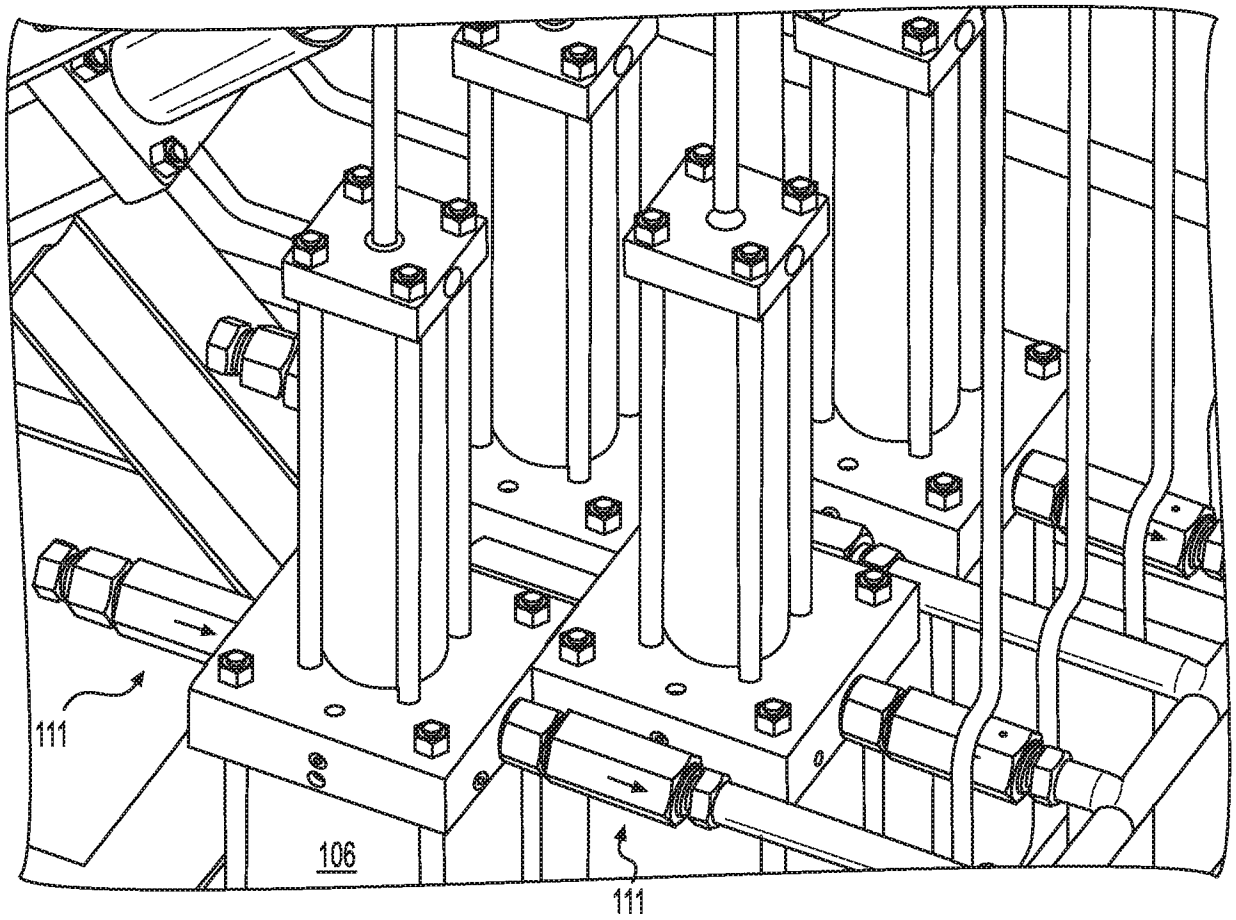
FIG. 7 illustrates an example view of the engine parts according to example embodiments.

FIG. 7 illustrates an example view of the air hydraulic booster according to example embodiments. Referring to FIG. 7, the system 700 includes a close-up perspective of the air valve 111 and the hydraulic piston over air cylinder 106. The hydraulic ram cylinder includes chamber A as an oil chamber and B as an air chamber. As the air hydraulic booster is energized the oil in the cylinder pressurizes and sends the oil to the ram cylinder A as the oil fills the chamber, the rod will move downward to the bottom of the ram cylinder. To retract the ram cylinder to a home position, the ram cylinder chamber B is energized with air and doing so the ram cylinder will retract to a home position and the cycle repeats.

Figure 8:
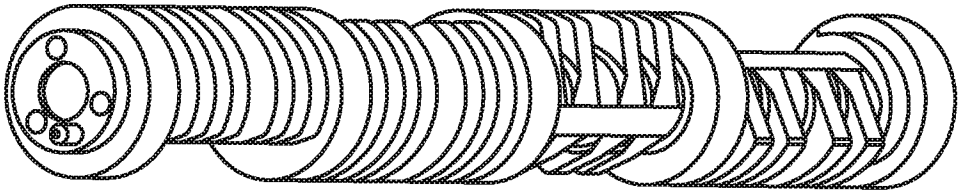
FIG. 8 illustrates a cam shaft front view according to example embodiments.

FIG. 8 illustrates a cam shaft front view according to example embodiments. To start the engine in a low revolution per minute (RPM) high-torque 8-cylinder motor engine, the 101 should be pressurized to 50 pounds per square inch (PSI) and tank 102 should be pressured to 150 PSI. Next, the presser regulator item 122 is set to 100 PSI. Then, the throttle valve 123 is opened and this will control the amount of pressurized air that flows into the system once the throttle valve is open, the engine will start to run by transferring pressurized air to the intake manifold item 105, then pressure will reach to air cylinder control valve item 109. Each set of 2 cylinders alternate every 90 degrees in rotation. At any time, 4 cylinders are in force and 4 cylinders are in retreat.

At an initial time #1 and #6 ram cylinders are in top dead center (TDC) position. 109 provides air to the #1 cylinder and the #6 cylinder, 2 cylinders are energized with 100 psi air pressure from item 109 air control valve to 106 (AHU) chamber A. This action boosts the air pressure to hydraulic pressure and intensifies it by 10 times or more. This hydraulic pressure is sent by high pressure hydraulic hose to ram cylinder 107 chamber A this action moves the ram cylinder rod in a downward movement. As the rod moved the connecting rod, item 114 is connected to crankshaft 112 from T.D.C. to a 90 degree position, then 2 sets of cylinders are energized including the #8 and the #5 cylinder, this action will move the crank shaft item number 112 an additional 90 degrees clockwise, at this time the #1 and #2 cylinders reach the 180 degree mark on the crank shaft. At the end of the stroke (180 degrees) after top dead center (ATDC), the 112 crank shaft is connected with the timing chain and sprocket assembly 115 to camshaft 116, this chain and sprocket assembly could operate as a 1-to-1 ratio and the camshaft and 116 is a 90 degree design and the lobes are 180 degrees on and 180 degrees off on the cam lobes set of lifters 117. The lifters are rolling around the lobes causing the lifters to ascend and descend around the lobes. On the lifters there are a set of lifting rods spring assemble item 118 the spring presses the lifters to rotate on the lobes continuously. And the lifting rod assemble item 118 runs through a set of linear bearing items 119 which are mounted on item 108, this bearing will keep the rod in a true and accurate position all the way to connect hydraulic valve 110 and 109, which are mounted on top of each other in a single action ascending and descending movement. This will activate both valves simultaneously permitting the air in the hydraulic oil to change direction as the #1 and #6 cylinders are in a 180 degree location, the cam 116 reverses the air and hydraulic valves to switch directions. At this time, 106 chamber A is de-energized. By de-energizing 106, chamber A permits the piston inside the 106 to be free and return home position without restriction.

As cylinders 1 and 6 are de-energized and start to retreat to a home position simultaneously, new sets of cylinders are energized including the #4 cylinder and the #7 cylinder. Energized cylinders rotate the crankshaft 112 an additional 90 degrees from a current position. At this time, the #8 and #5 cylinders start to retreat to a home position. At the same time, new sets of cylinders are energized including the #2 and #3 cylinders as they rotate the crankshaft an additional 90 degrees, the #1 and #6 cylinders are back to a TDC position and the cycle begins to repeat.

At all times, 4 cylinders are in force and 4 cylinders are in retreat. Every 90 degrees, a set of 2 cylinders are in rotation, including on in force and off in retreat.

Retreating of the cylinders works as the engine rotates the #1 cylinder and the #6 cylinder are 180 degrees after TDC. Each designated set of cylinders will return to a home position by connecting rod item 114, which forces the ramrod to retreat to a home position on item 107. In operation, oil in the ram cylinder in chamber A is forced back to a hydraulic piston over air cylinder 106. This action will retreat the air piston to a return to home position as well. At this point, air cylinder 106 is ready to be re-energized for another cycle. Another way to retract the cylinders to a home position is to energize the B chamber of 106 and 107.

One example of how the exhaust is captured provides that after de-energizing the air cylinder 106, chamber A, the exhaust is captured back by returning the pressurized air to the exhaust manifold item 104. On top of each returning exhaust line, there is an air check valve 111. This will not permit the exhaust air to return into the system. As the exhaust enters into 104, the exhaust manifold, the pressurized air returns to the low PSI tank 101. At that time, the air compressor 103 will move the low pressure air from the 101 tank to the high pressure tank 102, which concludes the cycle which then repeats.

Figure 9:
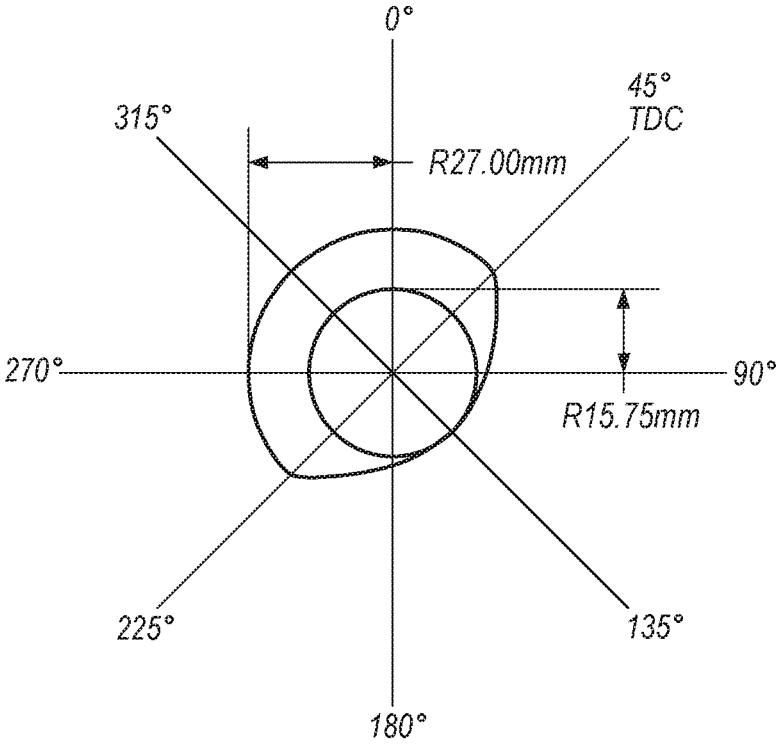
FIG. 9 illustrates a cylinder position pattern according to example embodiments.

FIG. 9 illustrates a cylinder position pattern according to example embodiments.

Figure 10:
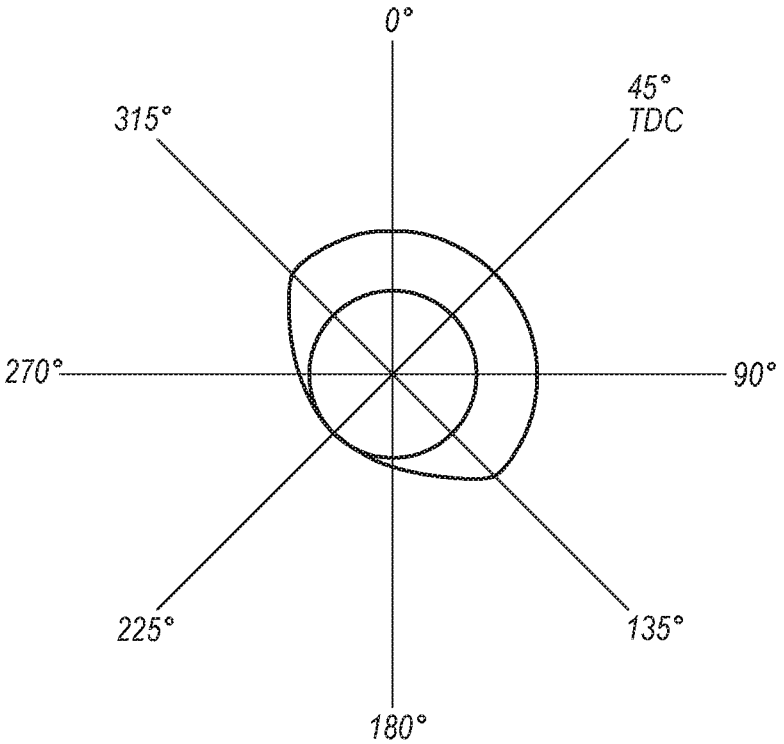
FIG. 10 illustrates another cylinder position pattern according to example embodiments.

FIG. 10 illustrates another cylinder position pattern according to example embodiments.

Figure 11:
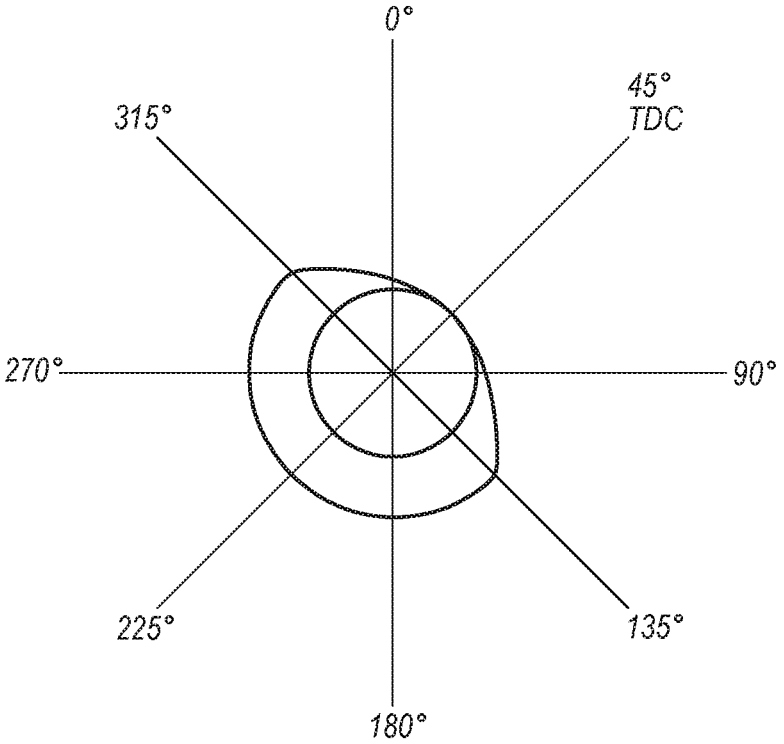
FIG. 11 illustrates yet another cylinder position pattern according to example embodiments.

FIG. 11 illustrates yet another cylinder position pattern according to example embodiments.

Figure 12:
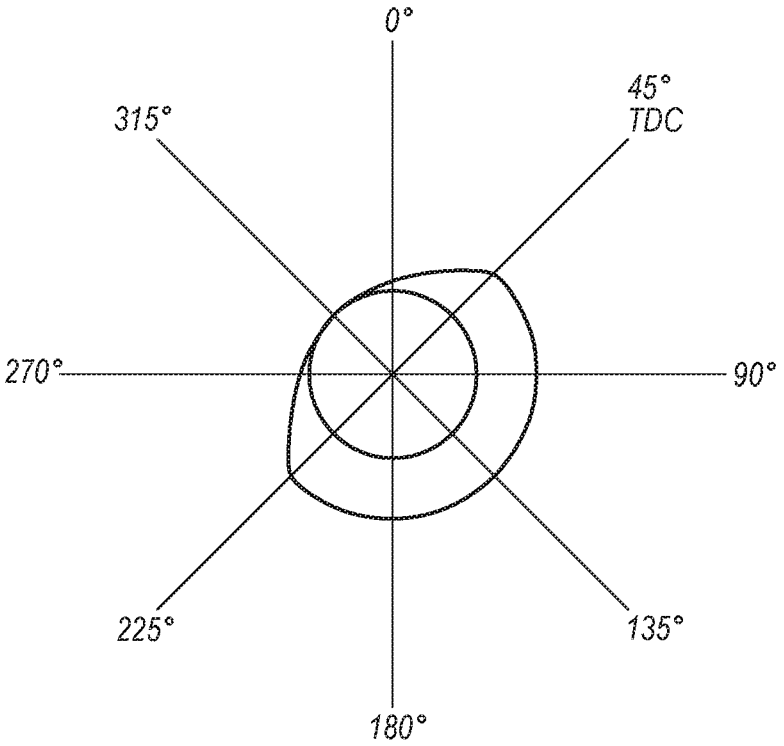
FIG. 12 illustrates still a further cylinder position pattern according to example embodiments.

FIG. 12 illustrates still a further cylinder position pattern according to example embodiments.

Figure 13:
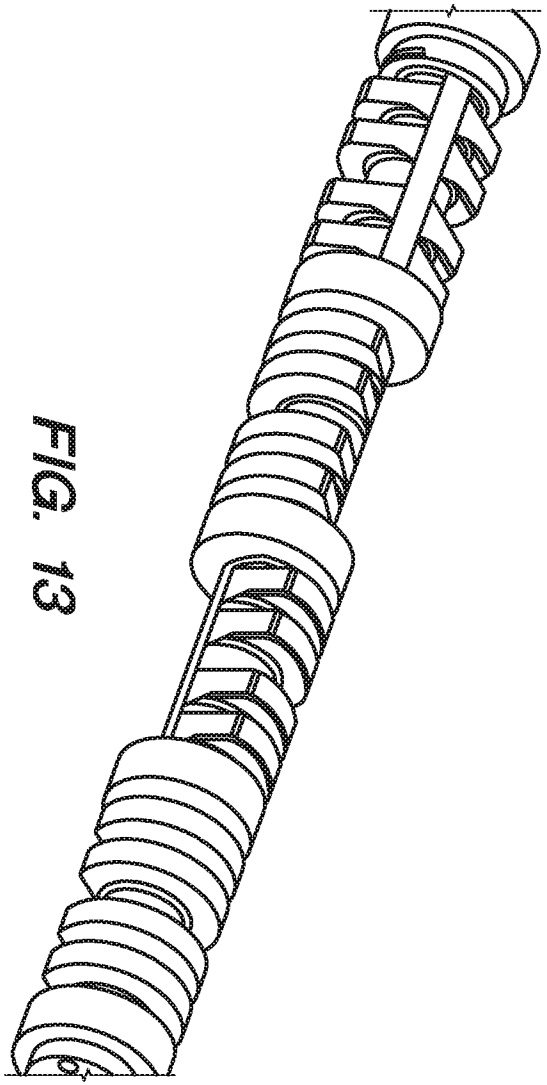
FIG. 13 illustrates a cam shaft side view according to example embodiments.

FIG. 13 illustrates a cam shaft side view according to example embodiments.

Figure 14:
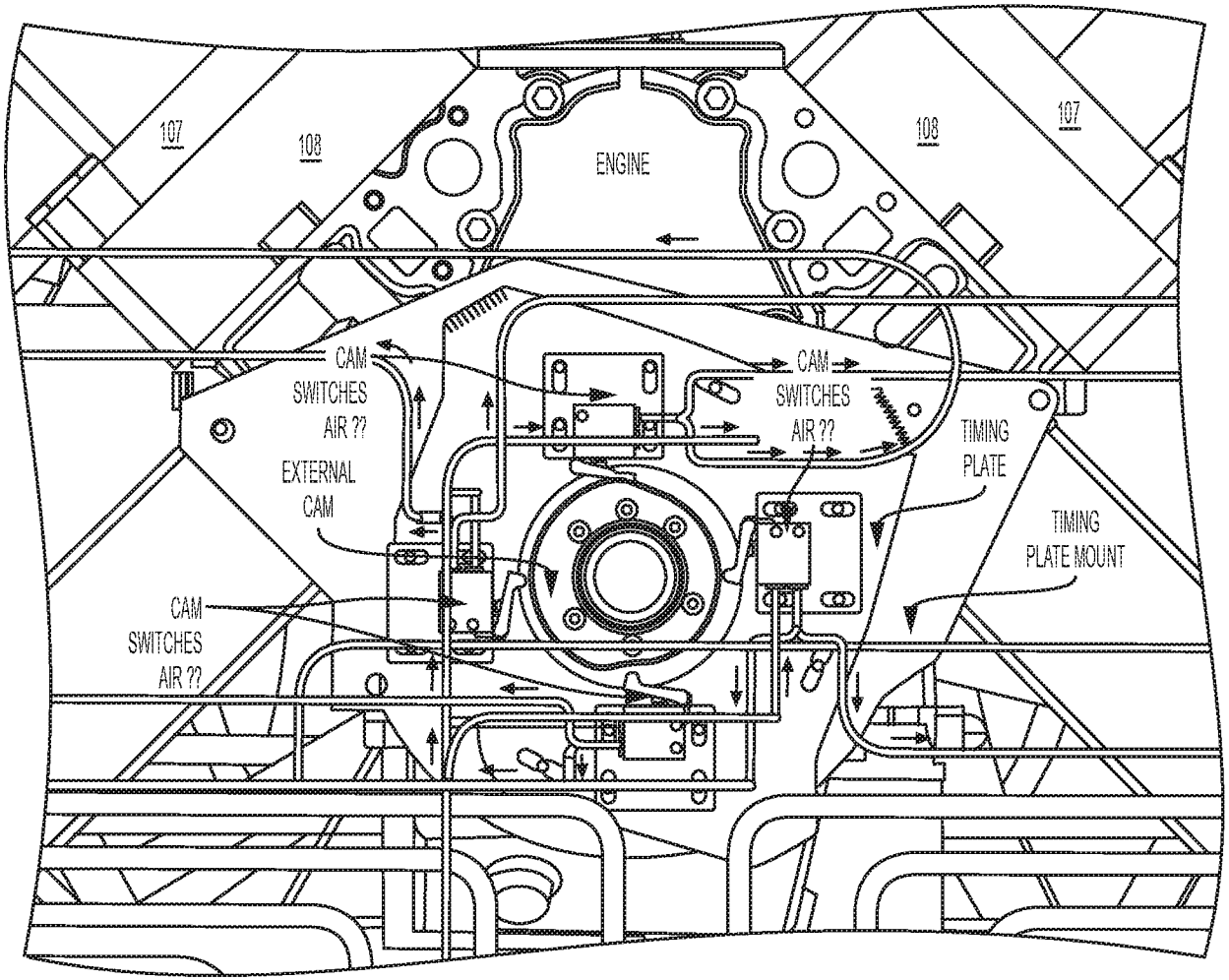
FIG. 14 illustrates a cam configuration according to example embodiments.

FIG. 14 illustrates a cam configuration according to example embodiments. External cam system and the external cams are located on the main crankshaft 112. On the cam there are four air assisted switches pressurized to 100 psi. These switches are mounted on the timing plate and the timing plate is mounted on the timing mounting plate so when the engine starts to operate the switches are mounted 90 degrees apart from each other. At the TDC switch, numbers 1 and 6 are pressed by the cam pressurized air signal which transfers to 109 energize item number 106 chamber A and rotation begins. Then the cylinder switches to numbers 5 and 8 and the numbers 7 and 4 and then 2 and 3 and the whole process repeats.

Figure 15:
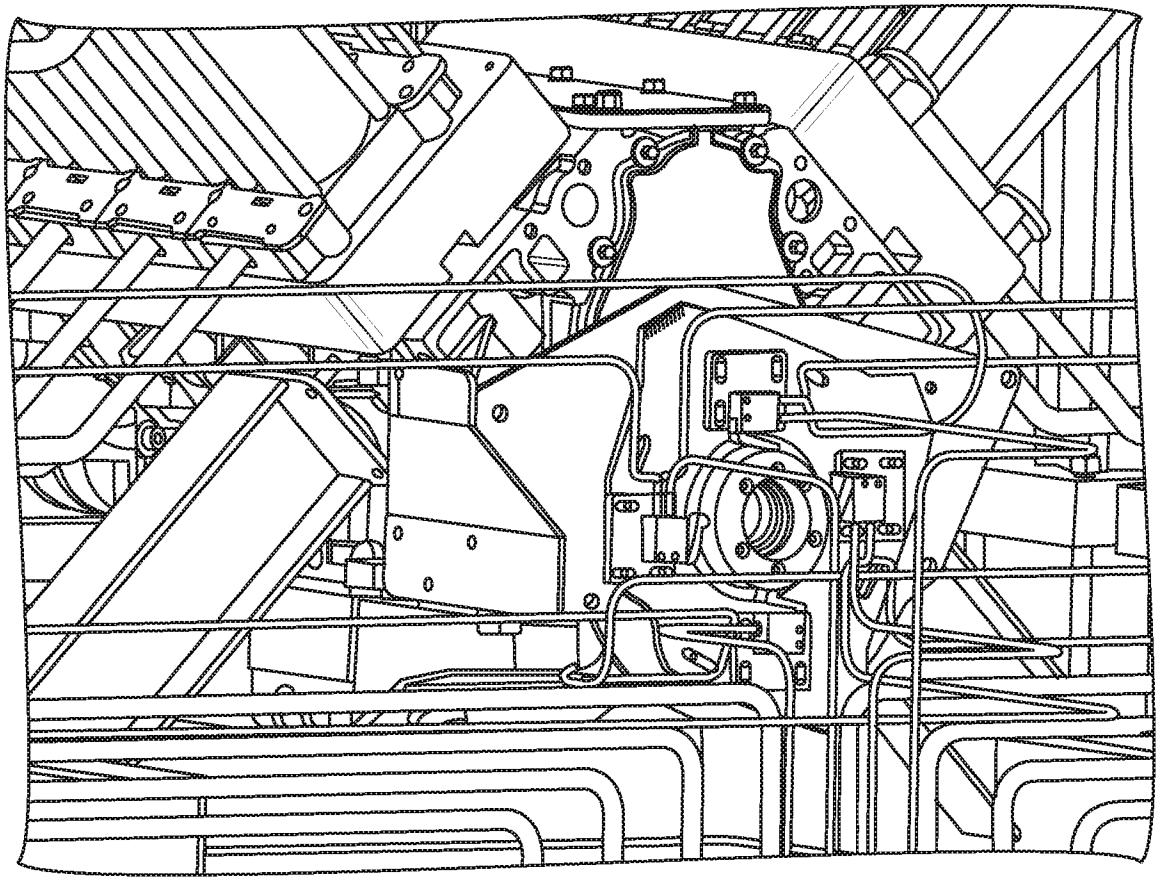
FIG. 15 illustrates a cam configuration according to example embodiments.

FIG. 15 illustrates a cam configuration according to example embodiments.

It will be readily understood that the components of the application, as generally described and illustrated in the figures herein, may be arranged and designed in a wide variety of different configurations. Thus, the detailed description of the embodiments is not intended to limit the scope of the application as claimed, but is merely representative of selected embodiments of the application.

Therefore, although the application has been described based upon these preferred embodiments, it would be apparent to those of skill in the art that certain modifications, variations, and alternative constructions would be apparent, while remaining within the spirit and scope of the application. In order to determine the metes and bounds of the application, therefore, reference should be made to the appended claims.

What is claimed is:

1. A system, comprising:

at least two high pressure gas tanks, wherein a first high pressure tank has a different first gas pressure level from a second gas pressure level of a second high pressure tank;

an engine comprising a plurality of cylinder head adapters configured to receive a corresponding plurality of hydraulic ram cylinders;

at least one hydraulic ram cylinder comprising an oil chamber, a gas chamber, and a cylinder head, wherein a gas pressure received from at least one of the two high pressure tanks causes a gas pressure of the gas chamber to increase which causes the cylinder head to move away from the oil chamber, and to pump oil into the oil chamber; and an oil pump configured to pump the oil back into the engine.

2. The system of claim 1, wherein the first high pressure tank provides the gas pressure increase to the gas chamber.

3. The system of claim 1, wherein as the cylinder head moves the first gas pressure level of the first high pressure tank decreases.

4. The system of claim 1, wherein once the cylinder head has moved, the hydraulic gas pressure is exhausted into the second high pressure tank which increases the second gas pressure level.

5. The system of claim 1, further comprising an air compressor connected to the first high pressure tank and the second high pressure tank.

6. The system of claim 5, wherein the air compressor performs at least one of lowers and increases the first gas pressure level.

7. The system of claim 5, wherein the air compressor performs at least one of lowers and increases the second gas pressure level.

8. The system of claim 1, wherein the gas is air.

9. The system of claim 1, further comprising a transmission connected to the engine configured to change gears.

10. The system of claim 1, wherein the first gas pressure level of the first tank is initially set three times greater than the second gas pressure level of the second tank.

11. A system, comprising:

an engine comprising a plurality of cylinder head adapters configured to receive a corresponding plurality of hydraulic ram cylinders;

at least one hydraulic ram cylinder comprising an oil chamber, a gas chamber, and a cylinder head, wherein a gas pressure received from at least one of a first high pressure gas tank and a second high pressure gas tank causes a gas pressure of the gas chamber to increase which causes the cylinder head to move away from the oil chamber, and to pump oil into the oil chamber; and an oil pump configured to pump oil back into the engine.

12. The system of claim 11, wherein the first high pressure tank provides the gas pressure increase to the gas chamber.

13. The system of claim 11, wherein as the cylinder head moves the first gas pressure level of the first high pressure tank decreases.

14. The system of claim 11, wherein once the cylinder head has moved, the hydraulic gas pressure is exhausted into the second high pressure tank which increases the second gas pressure level.

15. The system of claim 11, further comprising an air compressor connected to the first high pressure tank and the second high pressure tank.

16. The system of claim 15, wherein the air compressor performs at least one of lowers and increases the first gas pressure level.

17. The system of claim 15, wherein the air compressor performs at least one of lowers and increases the second gas pressure level.

18. The system of claim 11, wherein the gas is air.

19. The system of claim 11, further comprising a transmission connected to the engine configured to change gears.

20. The system of claim 11, wherein the first gas pressure level of the first tank is initially set three times greater than the second gas pressure level of the second tank.

* * * * *